US005461401A

United States Patent [19]

Shrivastava et al.

[11] Patent Number: 5,461,401

[45] Date of Patent: Oct. 24, 1995

[54] FREQUENCY OPTIMIZED INK JET PRINTER

[75] Inventors: Dilip K. Shrivastava, Wheeling; Pietro C. Lostumbo, Wooddale, both of Ill.

[73] Assignee: Videojet Systems International, Inc., Wooddale, Ill.

[21] Appl. No.: 971,959

[22] Filed: Nov. 5, 1992

[51] Int. Cl.[6] ..... B41J 2/04

[52] U.S. Cl. ..... 346/54; 346/85

[58] Field of Search ..... 347/54, 85

[56] References Cited

U.S. PATENT DOCUMENTS

| | | | |
|---|---|---|---|
| 4,223,323 | 9/1980 | Bader et al. | 347/85 |
| 4,378,564 | 3/1983 | Cross et al. . | |
| 4,412,233 | 10/1983 | Thomas et al. | 347/85 |
| 4,462,037 | 7/1984 | Bangs et al. | 347/85 |
| 4,503,445 | 5/1985 | Fridman . | |
| 4,728,969 | 3/1988 | Le et al. | 347/21 |
| 4,792,817 | 12/1988 | Barney . | |

FOREIGN PATENT DOCUMENTS

| | | | |
|---|---|---|---|
| 0036295 | 9/1981 | European Pat. Off. . | |
| 0009988 | 5/1994 | WIPO | 347/85 |

OTHER PUBLICATIONS

Videojet Maxum Product Guide, 1986, pp. 1–1 to 1–5; 4–1 to 4–17.

*Primary Examiner*—Matthew S. Smith
*Attorney, Agent, or Firm*—Rockey, Rifkin and Ryther

[57] ABSTRACT

Ink jet printers used for printing large characters employ a separate solenoid valve for each drop stream which forms part of a printhead matrix. By optimizing the frequency response of the nozzle/valve sub system (primarily the connecting tubing), higher operating frequencies can be obtained. It has been found that a ratio of six to one between subsystem resonant frequency and operating frequency provides greatly improved printing.

13 Claims, 9 Drawing Sheets

FREQUENCY OPTIMIZED INK JET PRINTER

BACKGROUND OF THE INVENTION

This invention relates to a drop-on-demand ink jet printing device commonly used for large character printing. In such devices, used for marking products, the on/off control of ink to a nozzle is accomplished by using a separate valve, remote from the orifice, which is connected thereto by a tubing assembly. A typical large character printhead will have a plurality of such valves and nozzles forming, for example, a seven by one printhead which can mark alphanumeric characters on products which pass the printhead.

The subsystem defined by the on/off valve, the nozzle and the tubing which interconnects the two has a natural frequency. In typical printheads of this type, the resonant frequency of the system is low. As the valve operating frequency approaches the resonant frequency of the ink delivery system, print quality deteriorates. Thus, even if the valves are capable of operating at higher frequencies, the resonant interference from the ink delivery subsystem reduces maximum printing frequency.

For example, current drop on demand printers of the type described operate at about 240 Hz. Currently available valve designs permit theoretical operation to at least 700 Hz. As print speed increases, however, interfering resonant frequencies cause severe print quality deterioration preventing operation at such higher frequencies.

It is accordingly an object of the present invention to provide an improved printhead having the capability of operating at higher frequencies than in the prior art.

It is a further object of the invention to provide a printhead in which the valve/output tube/nozzle has a natural frequency above and sufficiently removed from a desired operating frequency range that there is no resonant interference and consequent degradation in print quality.

A further object of the invention is to provide a method of optimizing the valve/output tube/nozzle for a printhead of the type described to maximize print quality by adjusting the fluid resonant frequency thereof.

These and other objects of the invention will be apparent from the remaining portion of the specification.

SUMMARY OF THE INVENTION

It has been determined that the fluid resonant frequency of the valve/output tube and nozzle combination (sometimes referred to as the ink delivery system) can be altered by controlling certain physical parameters. These include the length, diameter, wall thickness and durometer value of the tubing used to interconnect the valve to the nozzle. By selecting appropriate values it is possible to move the fluid resonant frequency of the delivery system significantly away from (above) the intended operating frequency, thereby to increase the upper limit on operating frequency at which good quality printing can be obtained.

DETAILED DESCRIPTION

As mentioned in the background section of the specification, standard large character printhead typically operate at a maximum frequency of about 240 Hz which translates to approximately 100 feet per minute in substrate speed. It is desired to provide higher speed printer capability, for example, operating at up to 700 feet per minute to produce one inch high characters. Such a device would require valve operating frequencies in the range of 750 to 850 Hz.

Existing printheads currently available as, for example, used in the MAXUM printer manufactured by the assignee of the present invention, Videojet Systems International, Inc., employ an ink delivery system in which a separate solenoid valve controls the ink supply to each nozzle. The valves are connected to the nozzles by lengths of flexible output tubing. The valve, nozzle and output tubing subsystem has a defined fluid resonant frequency. If the fluid resonant frequency of the subsystem is close to the valve operating frequency print quality deteriorates. In order to operate at higher speeds, it is necessary to significantly alter this resonant frequency so that it does not interfere with printing.

Figure 1:
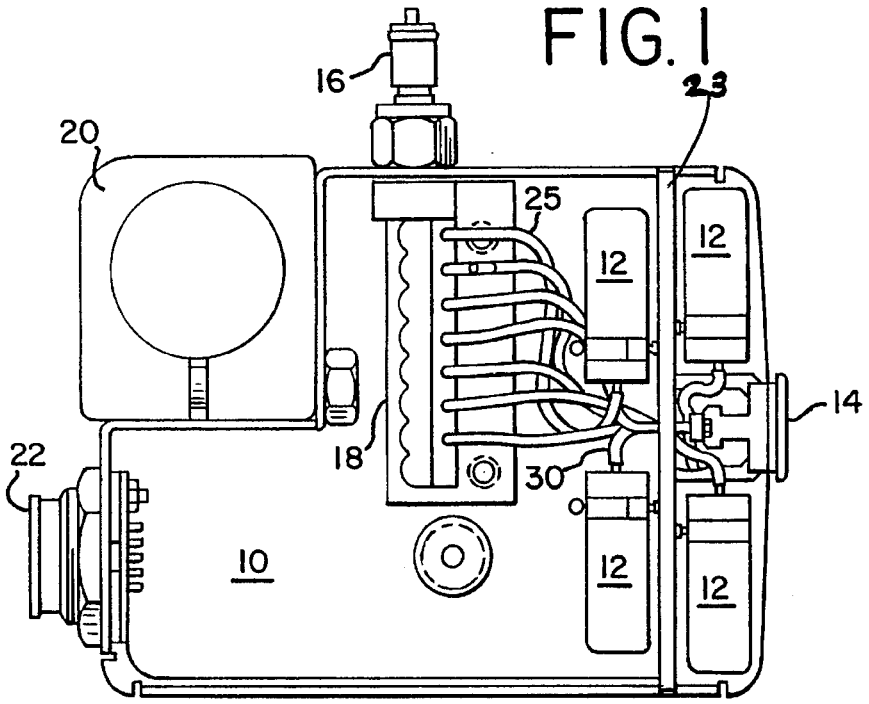
FIG. 1 is a top view of a printhead having the advantages of the invention incorporated therein.
Figure 2:
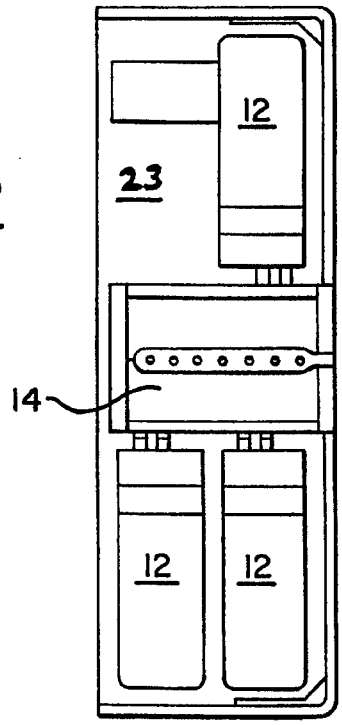
FIG. 2 is a view along the lines 2—2 of FIG. 1 showing the seven by one nozzle block.

Referring to FIG. 1, a printhead suitable for use with the invention is illustrated. Typically the printhead is formed on a housing 10 and a printed circuit board 23 to which the valves 12 are preferably secured. As indicated, there is a separate valve for each nozzle which forms a part of the printing array. As shown in FIG. 2, the illustrated embodiment has a nozzle block 14 having for example, seven or sixteen nozzles, each of which is defined by a jeweled orifice. Referring to FIG. 1, ink is supplied under pressure to the printhead 10 through a coupling 16. The ink passes to a common manifold 18. Flexible input tubing, 25, typically PVC, communicates the ink from the manifold to the inlet of each of the valves 12.

The printhead includes a mounting bracket 20 to permit it to be positioned for printing in the path of a moving substrate as, for example, a product moving on a conveyor. Electrical control signals are supplied to the valves through an electrical connector 22 and associated wiring, which for simplicity purposes, is not shown.

Figure 3:
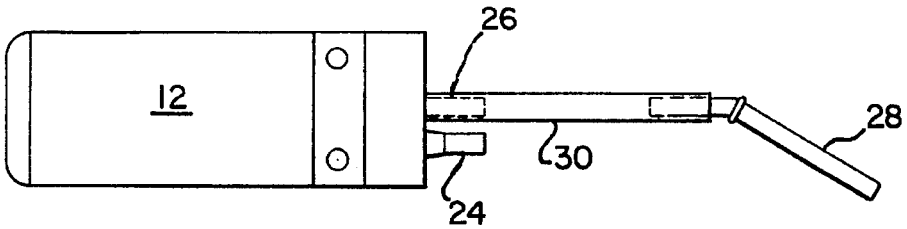
FIG. 3 is a side elevational view of a typical ink delivery system.

Referring to FIG. 3, the details of the valve/output tube/nozzle subassembly are illustrated. Each valve 12, receives ink from the manifold via an inlet 24 connected to the input PVC tubing 25. When operated by a signal from the printing system, the valve permits ink to flow to the outlet 26. The outlet is connected to a nozzle tube 28 by means of flexible output tubing 30. The nozzle tube, which is preferably a hollow metal tube, terminates in an opening having a jewel disposed therein for creating a printing orifice. The output tubing 30 is of a length, wall thickness and diameter to interconnect the valve and nozzle tube. For purposes of the present invention, the length, wall thickness, diameter and durometer of the output tubing 30, are carefully selected as will be explained hereafter.

Referring to FIGS. 4A to D test data is illustrated useful in understanding the benefits of the present invention. The test data shown in the FIGS. 4B to D was obtained using a relatively high speed valve capable of operating at speeds up to 700 Hz. Such valves are commercially available, for example, from the Lee Company, under the part designation EHS. For testing purposes in determining the resonant frequencies, the design variables were: (1) length, wall thickness, diameter and durometer of the tubing 30 interconnecting the valve and the nozzle; (2) the metal nozzle tube itself; (3) the jewel geometry; and (4) operating pressure.

Figure 4A:
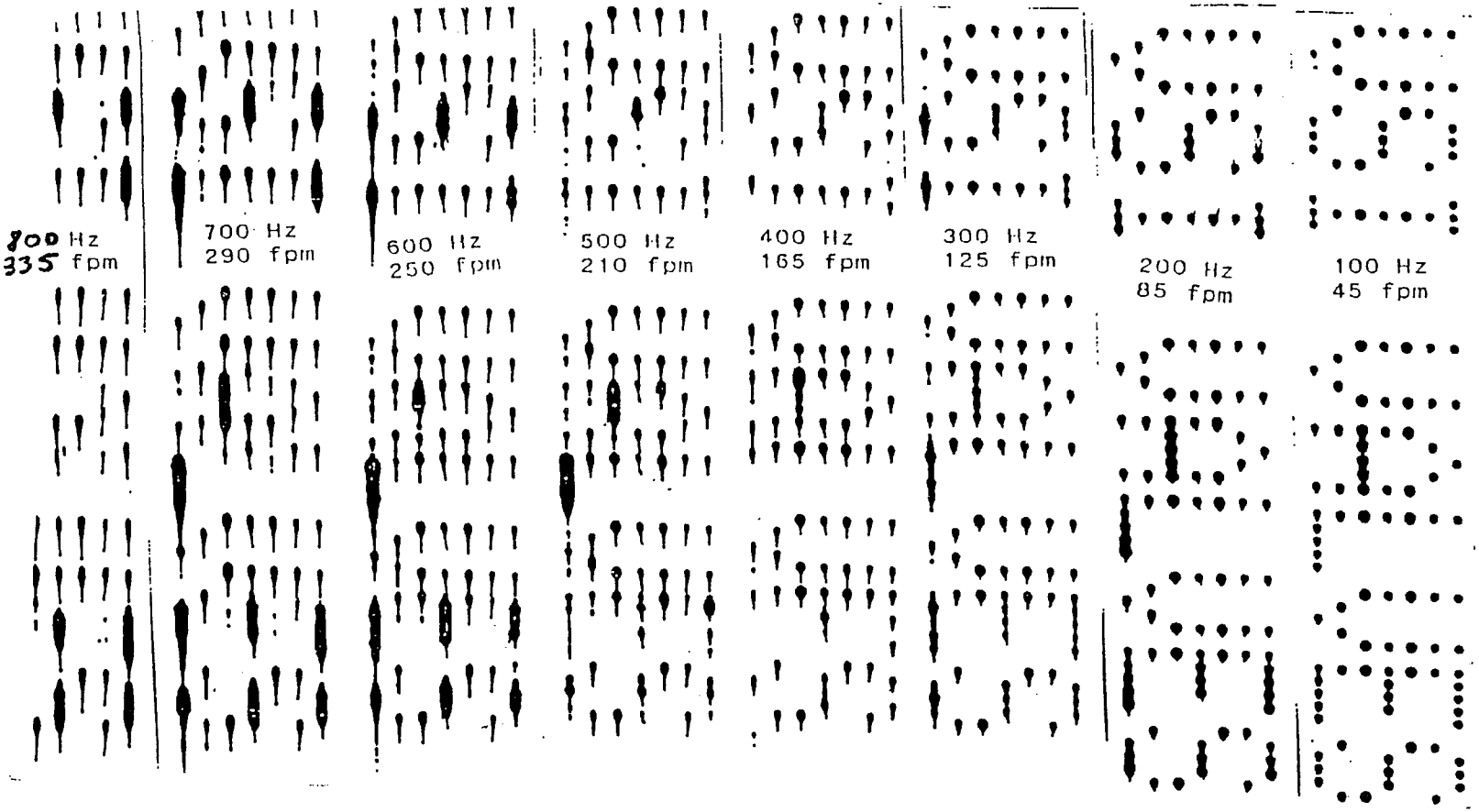
FIG. 4A–4D illustrates test data showing the effects of resonance on print quality.

FIG. 4A, for reference purposes, shows the operation of a standard valve as opposed to a high speed valve. As frequency of operation increases, it can be seen that the quality of the characters rapidly deteriorates and that the test letters "VSI VALVES" are almost unintelligible above 300 Hz.

Figure 4B:
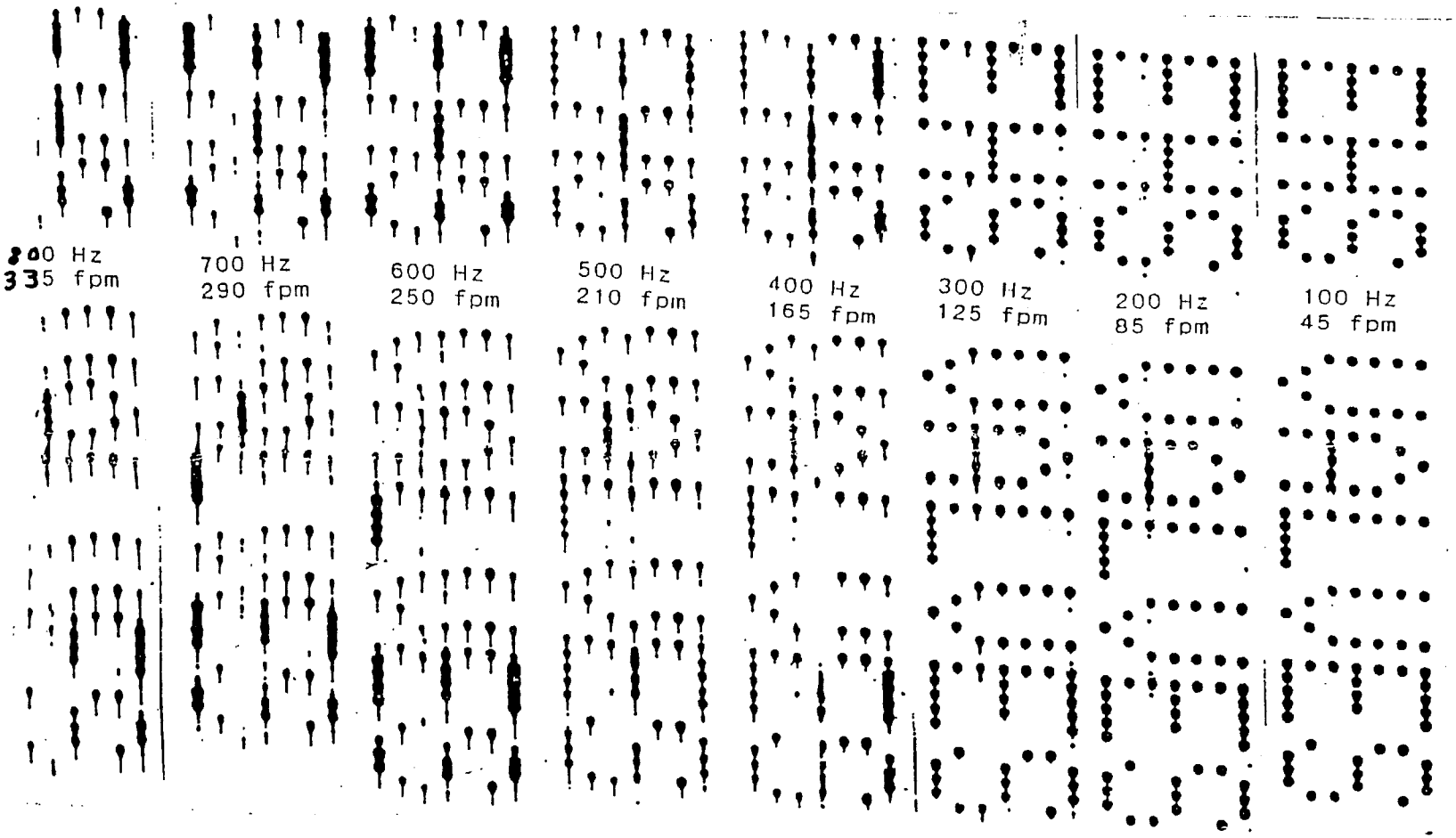
Figure 4C:
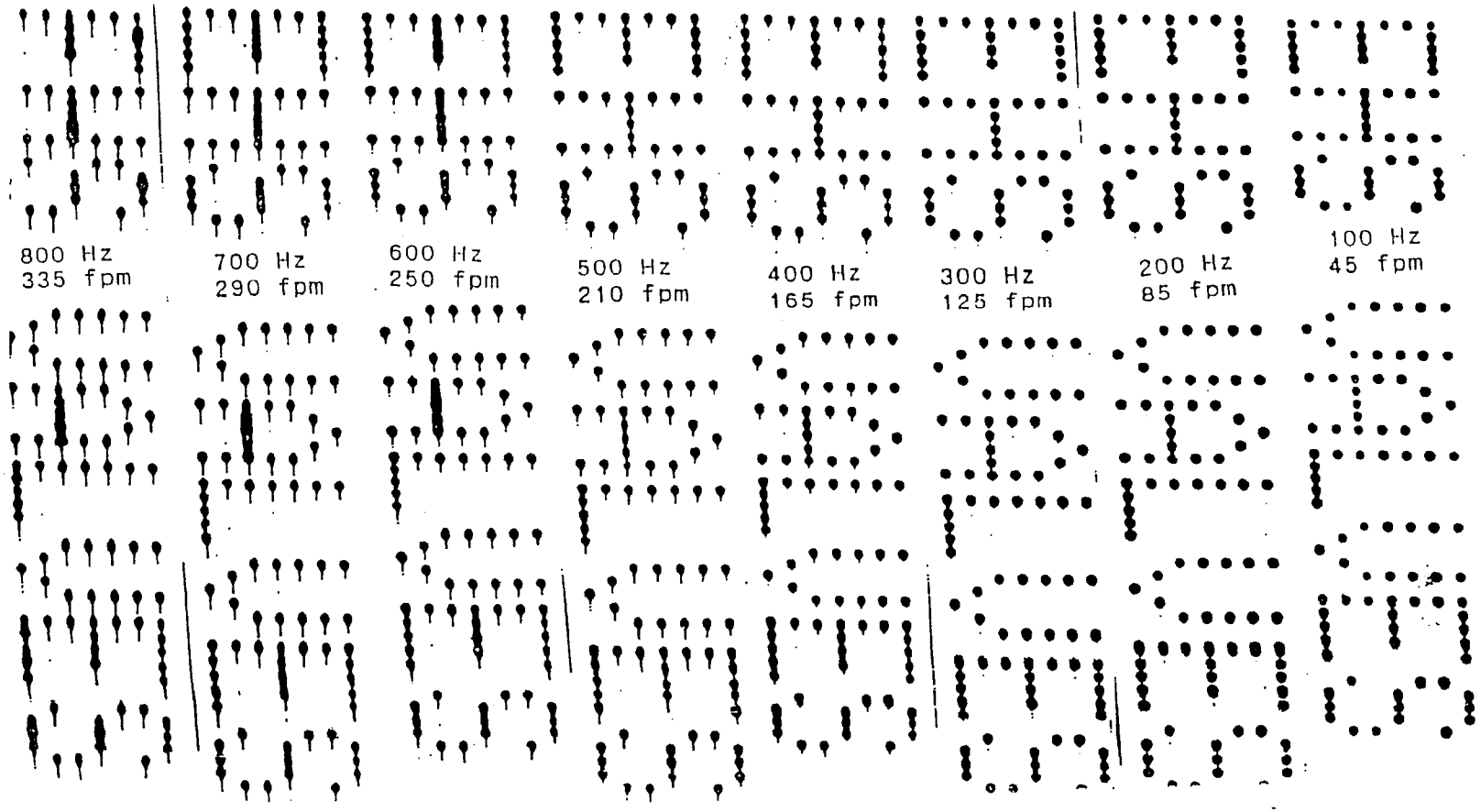

In FIG. 4B, high speed valves capable of operating at up to 700 Hz are employed. Although there is some improvement, it is still not possible to produce quality marking characters above 300 Hz. In FIG. 4C, the resonant frequency of the valve/nozzle subsystem was changed by increasing the resonant frequency to move it away from the intended valve operating range. This was accomplished solely by optimizing the length of the output tube. As can be seen, drop formation is improved and acceptable characters can be produced at up to about 500 Hz.

Figure 4D:
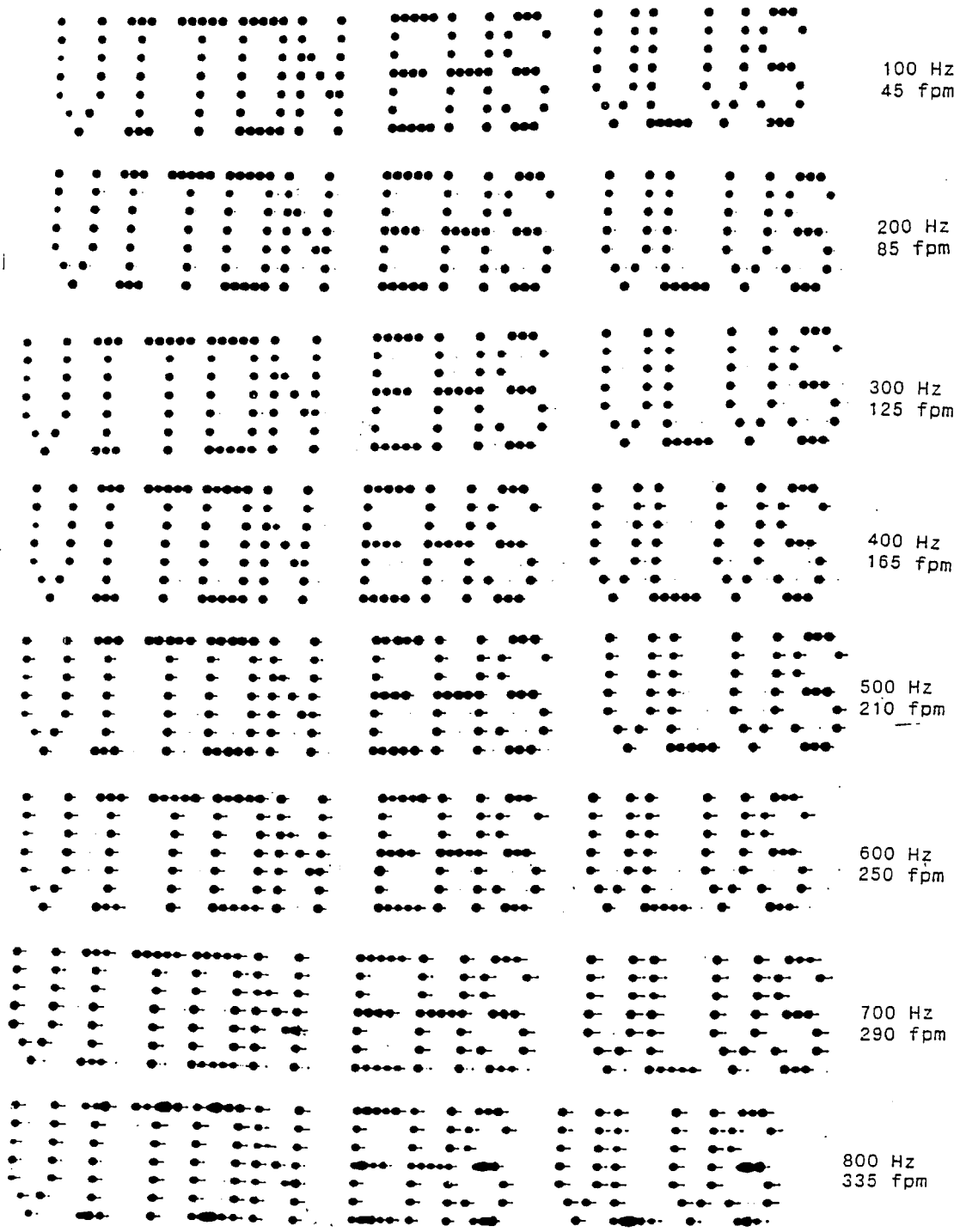

In FIG. 4D, the optimization was carried one step further by selecting a tubing of a particular durometer, wall thickness and diameter thereby further increasing the separation between operating frequency and resonant frequency. The result is striking. Acceptable characters can be produced at up to 700 Hz.

The manner in which these dramatic improvements in print quality at higher speeds are obtained will now be described. In particular, an analysis of the frequency response of the system was necessary. Frequency domain analysis proved most useful and computer simulation of system responses based on changes in the length, diameter, wall thickness and durometer of the plastic tubing, the metal nozzle tube, jewel geometry and operating pressure were calculated. After the calculations were completed, laboratory tests were conducted (of the type represented in FIGS. 4A–D) to verify the predicted data. Those skilled in frequency domain analysis will appreciate the manner in which this task can be carried out. For sake of completeness, a brief description of the analysis follows. Using equations which assume a sinusoidal variation of pressure head it is possible to break a periodic function into various harmonics by Fourier analysis and analyze each separately. The system response is determined by individual responses.

A field-transfer matrix F relates the state vectors at two adjacent sections of a tube. A point transfer matrix P relates the state vectors to the left and right of a discontinuity.

The continuity equation is given as $$\frac{\partial Q}{\partial x} + \frac{gA}{a^2}\frac{\partial H}{\partial t} = 0$$

and the momentum equation is given as $$\frac{\partial H}{\partial x} + \frac{1}{gA}\frac{\partial Q}{\partial t} + \frac{fQ^n}{2gDA^n} = 0$$

where

A→Cross-sectional area of the tube g→Acceleration due to gravity

D→Inside diameter of the tube f→Friction factor

X→Distance along the tube n→Exponent of velocity in friction term a→Wave velocity t→Time Q→Flow H→Piezometric head = frequency Neglecting the effects of friction Field Matrix is given as $$F_i = \begin{bmatrix} \cos(b_i\omega) & \frac{-j}{C_i}\sin(b_i\omega) \\ -jC_i\sin(b_i\omega) & \cos(b_i\omega) \end{bmatrix}$$

where $$b_i = \frac{l_i}{a_i}$$

$$C_i = \frac{a_i}{gA_i}$$

$l_i$ = lengh of tube

A computer program was written to calculate the transfer matrices for various lengths of tube 30, the metal nozzle tube and the jeweled orifice. The model described above gave very good agreement with laboratory results and generated a series of data which are graphed and presented in FIGS. 5 through 12. The overall response is given by:

$$\begin{bmatrix} q \\ h \end{bmatrix}_{orif} = \begin{bmatrix} \cos b_3\omega & -\frac{j}{C_3}\sin b_3\omega \\ -jC_3\sin b_3\omega & \cos b_3\omega \end{bmatrix} \begin{bmatrix} \cos b_2\omega & -\frac{j}{C_2}\sin b_2\omega \\ -jC_2\sin b_2\omega & \cos b_2\omega \end{bmatrix} \begin{bmatrix} \cos b_1\omega & -\frac{j}{C_1}\sin b_1\omega \\ -jC_1\sin b_1\omega & \cos b_1\omega \end{bmatrix} \begin{bmatrix} q \\ h \end{bmatrix}_{valve}$$

The suffixes 1, 2 & 3 are for the plastic tube, metal tube and jewel orifice respectively. The values used (lengths, inner-diameters and wall thickness) and the computed velocity of sound are specified at the top of each figure.

Figure 5:
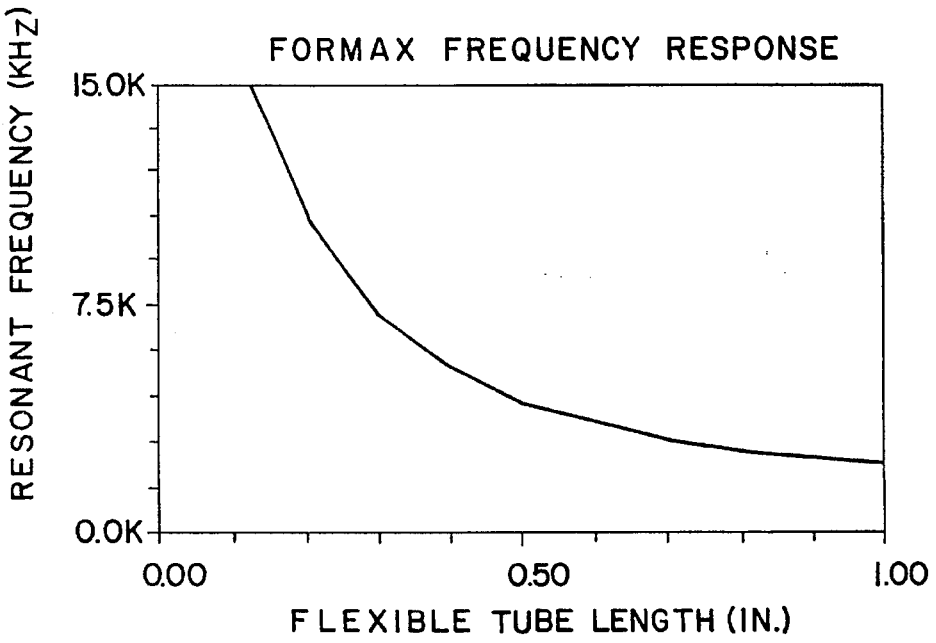
FIGS. 5 through 12 are graphs illustrating the relationship between resonant frequency of the delivery system and various physical parameters.
Figure 6:
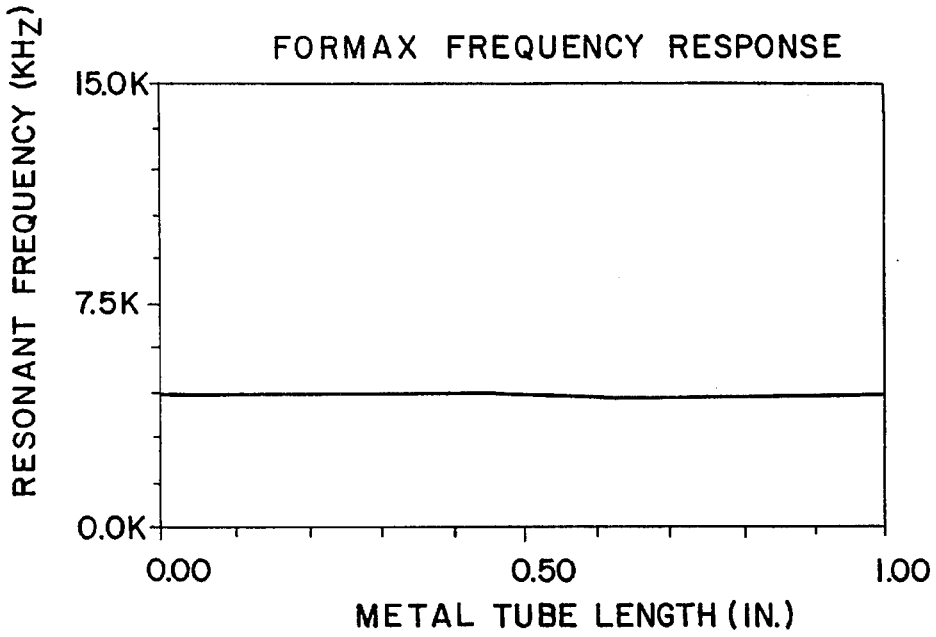
Figure 7:
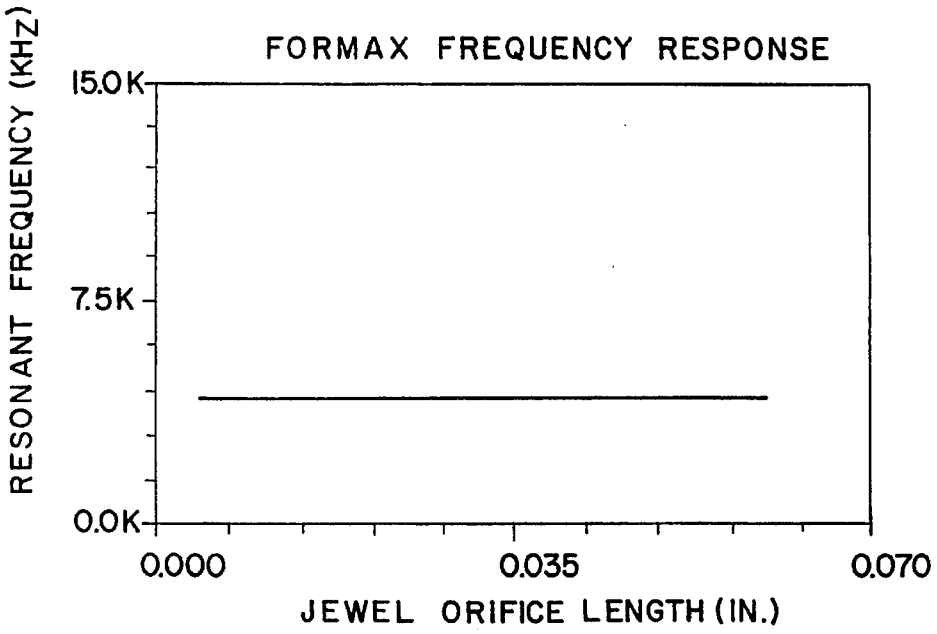

Referring to FIG. 5, it is seen that the resonant frequency varies inversely and significantly with the length of the tube 30. From FIG. 6 it can be seen that the length of the metal nozzle tube 28 does not materially affect the resonant frequency. From FIG. 7 it is also clear that the resonant frequency is relatively insensitive to jeweled orifice length.

Figure 8:
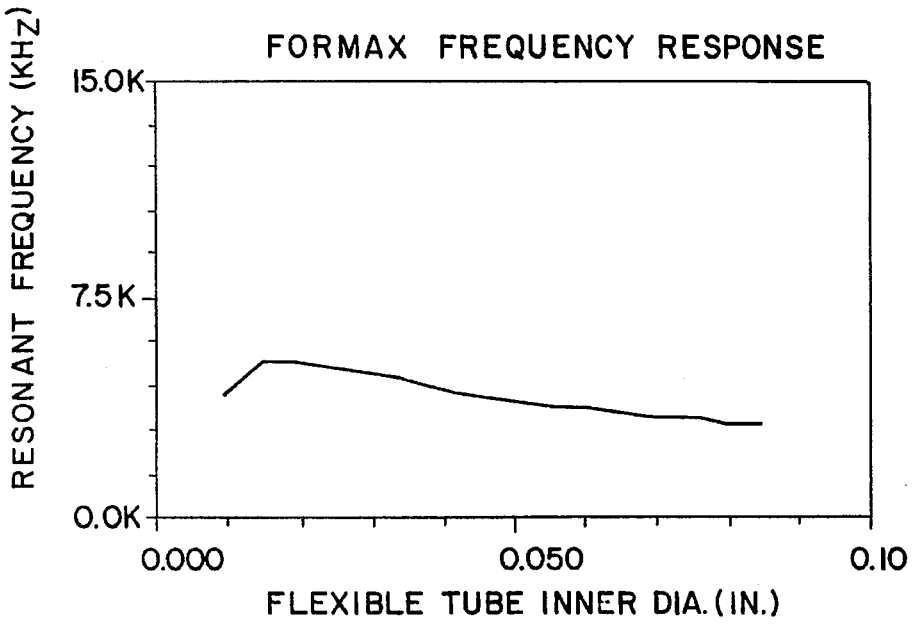
Figure 9:
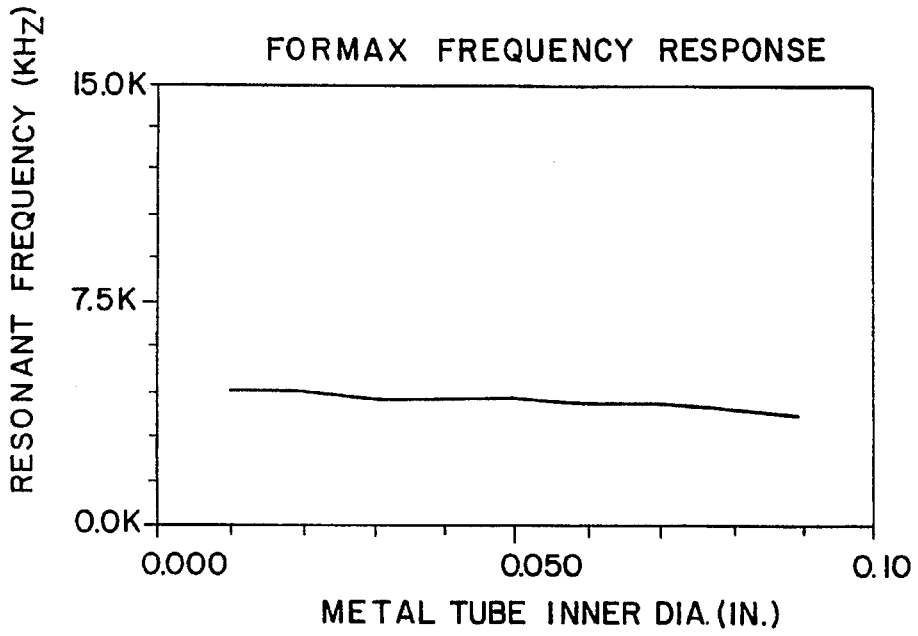

FIG. 8 illustrates that there is a meaningful relationship between resonant frequency and the inner diameter of the tube 30. FIG. 9 illustrates that there is only a slight relationship between resonant frequency and the inner diameter of the nozzle tube 28.

Figure 10:
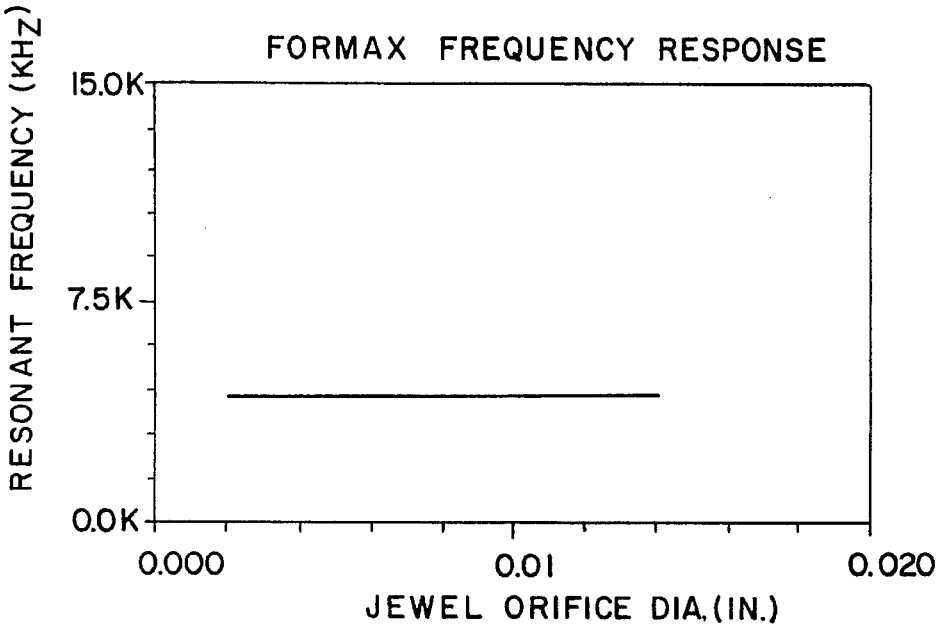
Figure 11:
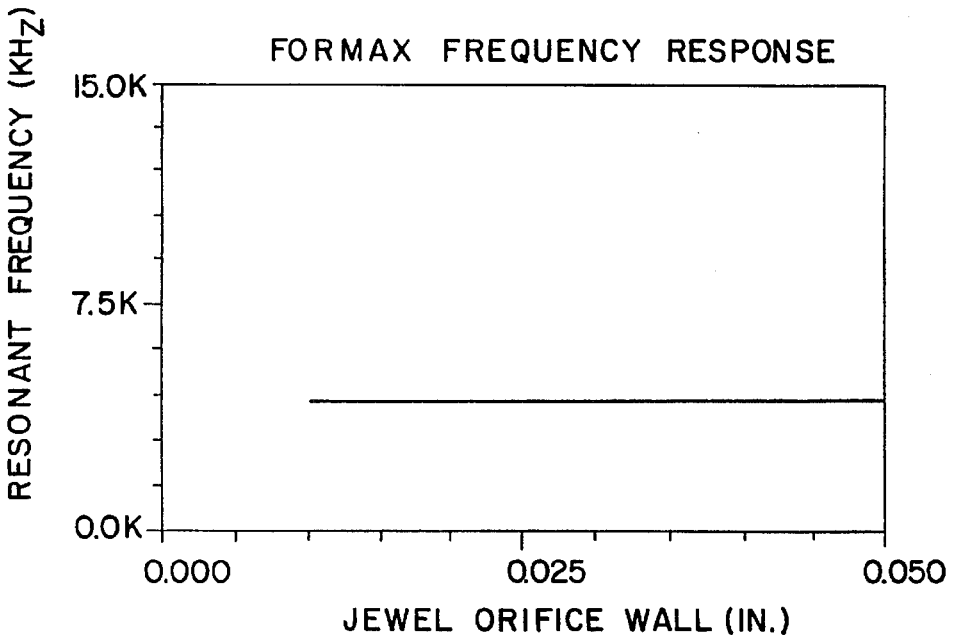

FIG. 10 and 11 indicate that there is no meaningful relationship between the jeweled orifice diameter and resonant frequency nor is there a meaningful relationship between resonant frequency and the jeweled orifice wall thickness.

Figure 12:
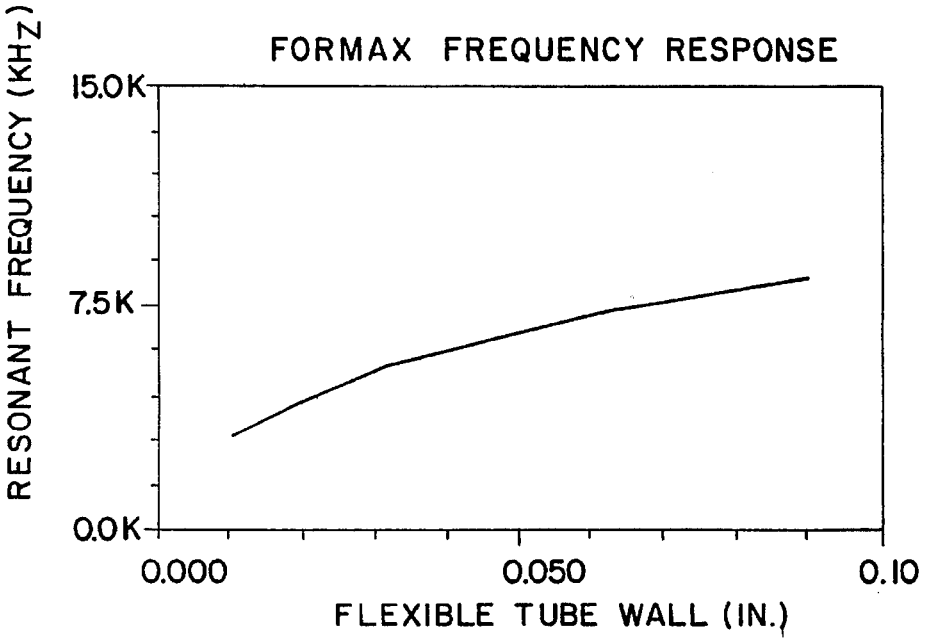

FIG. 12 illustrates that there is a direct relationship between frequency and the thickness of the wall of tube 30.

It is noted that there is no such relationship between the wall thickness of the metal nozzle tube 28.

From the foregoing data and analysis, it is clear that the characteristics of the tubing 30, have the most significant affect on the resonant frequency of the valve/nozzle subsystem. The data presented were used to produce the optimized printing shown in FIG. 4D. More specifically, optimum parameters were determined by selecting the optimum length, inner diameter and thickness of the tube 30. In the example illustrated in FIG. 4D, using ink pressure of 4 psi and a cup type jewel, the length of the plastic tubing was calculated to be 0.5 inches from the tip of the outlet on the valve to the tip of the inlet of the nozzle tube 28. The inner diameter of the tube was selected to be in the range of 0.024 to 0.031 inches and the wall thickness was selected to be in the range of 0.018 to 0.026 inches. The material chosen for the tubing 30 was selected on the basis of commercially available materials that most closely match the preferred durometer value. In the example of FIG. 4D, black Viton having a 70 shore A durometer reading was used.

It will be recognized by those skilled in the art, that the specific dimensions and material strengths given in the example are dependent upon the size of the printhead, the speed at which it is desired to print and various other initial assumptions. However, what the present invention has recognized as an improvement over the prior art is the need to design the system so that the fluid resonant frequency of the subsystem is above the highest frequency of operation desired for the printhead. Through additional calculations and testing, it is believed that best results are obtained when there is approximately a six to one ratio between the fluid resonant frequency in the tube subassembly and the maximum desired valve operating frequency. Although this is the preferred ratio, the invention will work reasonably well to provide improved printing as long as the ratio is at least three to one.

While preferred embodiments of the present invention have been illustrated and described, it will be understood by those of ordinary skill in the art that changes and modifications can be made without departing from the invention in its broader aspects. Various features of the present invention are set forth in the following claims.

What is claimed is:

1. An ink jet printing apparatus for projecting ink droplets comprising:

a) a pressurized source of ink;

b) a printhead having an orifice from which the droplets are projected;

c) a valve to control the flow of ink from said source to said orifice, said valve being capable of operating at frequencies above 250 Hz; and d) a flexible conduit for conducting the ink from said valve to said orifice, said conduit having a predetermined wall thickness, length, inside diameter and durometer to establish a fluid resonant frequency in said printhead of at least three times the highest frequency at which said valve is operated.

2. An ink jet printing apparatus for projecting ink droplets comprising:

a) a pressurized source of ink;

b) a printhead having a plurality of orifices from which the droplets are projected;

c) a plurality of valves, one for each orifice, to control the flow of ink from said source to the orifices, said valves being capable of operating at frequencies above 250 Hz; and d) a plurality of flexible conduits for conducting the ink from each valve to its corresponding orifice, said conduits having a predetermined wall thickness, length, inside diameter and durometer to establish a fluid resonant frequency in said printhead of at least three times the highest frequency at which said valves are operated.

3. The apparatus of claim 2 wherein the fluid resonant frequency is approximately six times the highest frequency at which said valves are operated.

4. The apparatus of claim 2 wherein said valves are operated at frequencies of approximately 750 Hz.

5. The apparatus of claim 1 wherein the fluid resonant frequency is approximately six times the highest frequency at which said valve is operated.

6. A printhead assembly for high speed printing of ink droplets comprising:

a) at least one orifice formed in said printhead;

b) valve means for controlling the flow of ink to said orifice(s), said valve means being operable at frequencies above 250 Hz; and c) a plurality of flexible conduits, one for each orifice, for conducting ink from said valve means to said orifice(s), said conduits having a predetermined wall thickness, length, inside diameter and durometer to establish a fluid resonant frequency of at least three times the highest frequency at which said valve means is operated.

7. A method for high speed printing of ink droplets in a printhead having a plurality of orifices therein supplied with ink from ink control valves via flexible conduits comprising the steps of:

a) operating said ink control valves at frequencies above 250 Hz; and b) selecting a predetermined wall thickness, length, inside diameter and durometer for each conduit to establish a fluid resonant frequency in said printhead of at least three times the highest frequency at which said control valves are operated thereby to avoid loss of print quality due to resonant interference.

8. A printhead for projecting ink drops comprising a drop-forming orifice connected by a flexible conduit to a valve for controlling the flow of ink under pressure to the orifice, the valve being operable at frequencies above 250 Hz, said conduit having a predetermined wall thickness, length, inside diameter and durometer to establish a fluid resonant frequency in said printhead of at least three times the highest frequency at which said valve is operated.

9. A printhead as claimed in claim 8 which is provided with a plurality of drop-forming orifices each connected by a respective flexible conduit to a respective valve for controlling the flow of ink under pressure to the associated orifice, each valve being operable at a frequency above 250 Hz each of said conduits having a predetermined wall thickness, length, inside diameter and durometer to establish a fluid resonant frequency in said printhead of at least three times the highest frequency at which the valves are operated.

10. A printhead as claimed in claim 9, wherein the fluid resonant frequency of each flexible conduit is between five times and seven times the highest frequency at which the associated valve is operated.

11. A printhead as claimed in claim 10, wherein the fluid resonant frequency of each flexible conduit is approximately six times the highest frequency at which the associated valve is operated.

12. A printhead as claimed in claim 8, wherein each valve is operable at a frequency of between 650 Hz and 800 Hz.

13. A printhead as claimed in claim 8, where each valve is operable at a frequency of approximately 750 Hz.

* * * * *